United States Patent [19]

Olsson et al.

[11] Patent Number: 4,496,112

[45] Date of Patent: Jan. 29, 1985

[54] METHOD OF CONTROLLING A WEB WINDING PROCESS

[75] Inventors: Ingemar Olsson; Göran Ottosson; Bengt Sinner, all of Västerås, Sweden

[73] Assignee: ASEA Aktiebolag, Västerås, Sweden

[21] Appl. No.: 480,280

[22] Filed: Mar. 30, 1983

[30] Foreign Application Priority Data

Apr. 1, 1982 [SE] Sweden ..... 8202095

[51] Int. Cl.[3] ..... B65H 17/08; B65H 59/08

[52] U.S. Cl. ..... 242/66; 242/75.51

[58] Field of Search ..... 242/66, 75.51, 75.5, 242/186, 187, 196

[56] References Cited

U.S. PATENT DOCUMENTS

| | | | |
|---|---|---|---|
| 3,000,584 | 9/1961 | Clem | 242/66 |
| 3,687,388 | 8/1972 | Pfeiffer | 242/66 X |
| 3,730,450 | 5/1973 | Hank | 242/75.1 X |
| 3,834,648 | 9/1974 | Rose, Jr. et al. | 242/186 |
| 3,858,820 | 1/1975 | Crouse | 242/66 |
| 3,976,258 | 8/1976 | Ruscher | 242/75.51 |
| 4,125,881 | 10/1978 | Eige et al. | 242/186 |

*Primary Examiner*—John M. Jillions
*Assistant Examiner*—Leo J. Peters
*Attorney, Agent, or Firm*—Watson, Cole, Grindle & Watson

[57] ABSTRACT

A method of controlling the internal tension of a web roll, in particular a paper web roll during winding of the roll in a winder having two, individually driven supporting rollers. The rotational speeds of the supporting rollers or their drive members are measured, whereby the speed signals are fed to control means for controlling the rotational speeds of the supporting rollers to maintain a desired speed difference therebetween for controlling the web tension wound into the roll.

5 Claims, 5 Drawing Figures

FIG. 3 (PRIOR ART)
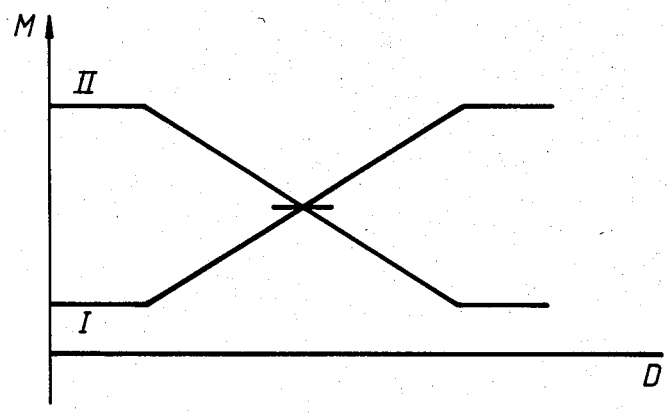
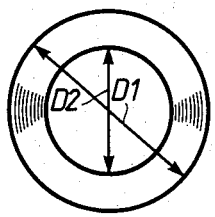
FIG. 4
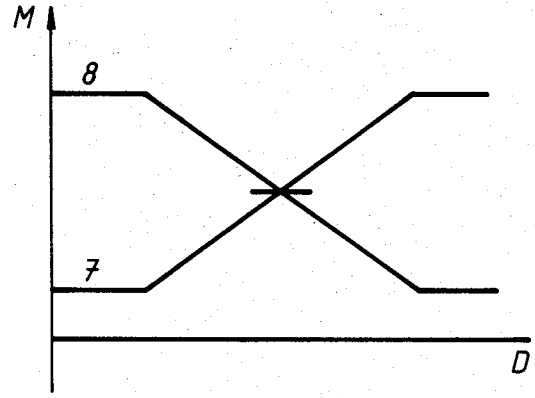
FIG. 5

METHOD OF CONTROLLING A WEB WINDING PROCESS

BACKGROUND OF THE INVENTION

This invention relates to a method of controlling the tension of a web during winding of the web into a web roll, the web roll being wound with the aid of two supporting rollers, each driven by a separate drive member. Although the method in accordance with the invention is intended primarily for controlling the tension of a paper web, it can be employed for the handling of webs of other materials.

In web winding operations of the above kind, it is desirable to have accurate control of the mechanical tensions wound into the web roll (i.e., the internal tension of the web roll) so, as to avoid disturbances, wrinkles and other damage to the web roll. The present invention aims to provide a web winding process in which these and other problems are avoided.

SUMMARY OF THE INVENTION

According to one aspect of the present invention a method of controlling the web tension of a web roll, in particular a paper web roll, being wound in a winder including two individually driven web roll supporting rollers, comprises deriving separate speed signals representative of the speed of rotation of each supporting roller, and controlling the speed of rotation of each driven supporting roller based on the difference between the speed signals, thereby controlling the web tension of the web roll.

Such a method provides a simple and efficient control of the web winding without causing abrupt speed changes, jerks, wrinkles in the web, etc., and provides an accurate control of the tension in the wound web roll.

According to another aspect of the present invention a method of regulating the internal web tension of a web roll, e.g., a paper web roll, being wound in a winder including two individually driven web roll supporting rollers, comprises deriving a measured signal representative of the difference between the speeds of rotation of the two supporting rollers, comparing the measured signal with a reference signal to obtain an error signal, and using the error signal to regulate the rotational speed difference between the supporting rollers thereby regulating the internal web tension of the web roll as the latter is being wound.

BRIEF DESCRIPTION OF THE DRAWINGS

The invention will now be described, by way of example, with reference to the accompanying drawings, in which:

FIGS. 3 and 5 are graphs each showing, for paper rolls wound in the apparatuses of FIGS. 1 and 2, respectively, the relationship between torque of a motor driving a supporting roller of the respective apparatus and the diameter of the paper roll during a winding operation; and FIG. 4 shows inner and outer diameters of a portion of a paper roll being wound during a winding operation.

DETAILED DESCRIPTION OF THE PREFERRED EMBODIMENT

Figure 1:
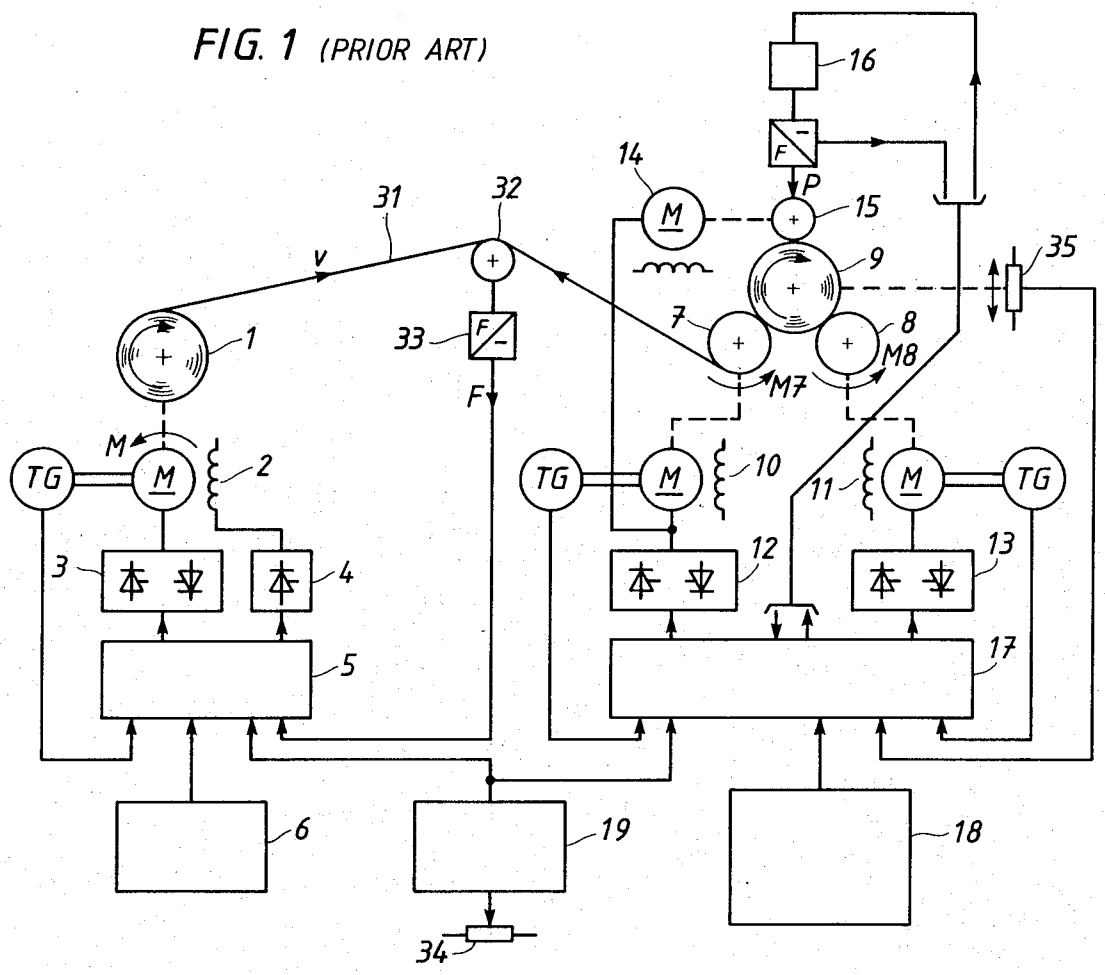
FIG. 1 (PRIOR ART)
FIG. 1 shows schematically prior art apparatus for regulating the tension of a paper web as it is wound into a paper roll.

In the prior art apparatus shown in FIG. 1, reference numeral 1 designates a paper roll being unrolled or unwound from an uncoiling capstan which is operated by a separately excited DC motor 2. The motor 2 has a rotor circuit fed by a thyristor convertor 3 and a field circuit fed by a thyristor or diode convertor 4. Control equipment 5 is provided to maintain a substantially constant tensile stress F in the endless paper web 31 unwound from the roll 1 independently of the roll diameter (D), the web speed (v), and any acceleration or deceleration of the web or roll 1. The control equipment 5 for controlling the unwinding also comprises circuits for separate running (speed control) of the uncoiling capstan. The values of D, F, etc., can be set in the control device 6.

The paper web 31 runs over a deflector roll 32 with a device 33 for measuring the tensile force, and the measured value signal F is supplied to the control equipment 5 in a closed control loop. The motor 2 is speed- or torque-controlled.

After the deflector roll, the paper web 31 is passed around a speed-controlling support roller 7, which in turn is driven by a separately-excited DC motor 10 having a rotor circuit fed by a thyristor convertor 12. The paper web is then wound on a roll core (not shown) into a roll 9, the roll 9 also being supported by a further supporting roller 8 which is driven by a separately-excited DC motor 11 having a rotor circuit fed by a thyristor converter 13. The second roller 8 is torque-controlled during the winding operation.

A rider roll 15 is arranged on the roll 9, the rider roll 15 being driven by a separately-excited DC motor 14. The DC motors 10, 11, 14 may have their field circuits fed by diode convertors.

The numeral 17 designates a control equipment for controlling the winding up operation, its task being to ensure that the finished paper roll 9 acquires the desired tension profile (hardness), i.e., a control is desired of the stress rolled into the roll 9. This is carried out in a conventional manner via control of the tensile stress in the web F, the pressure P of the rider roll 15 and the torque ratio between the supporting roller 7 (M7, torque at 7) and the supporting roller 8 (M8, torque at 8).

The relationship between torque (M) and roll diameter (D) is illustrated in FIG. 3, where reference numeral I designates the torque of a motor 10 (roller 7) and reference numeral II designates the torque of a motor 11 (roller 8). The tension of the paper in the roll is controlled via the torques of the two motors 10 and 11, and in this case the torque II (motor 11) is greatest at a small roll diameter and smallest at a large roll diameter. Upon speed changes, there will often arise problems in connection with this conventional method, resulting in the drawbacks described above.

From a central reference system 19 (in FIG. 1) a reference value is obtained for the desired paper web speed, and the change of the speed normally occurs by means of a ramp device 34. The diameter of the roll 9 can be measured at 35. The hardness at the beginning and end, respectively, of the winding- or rolling-up operation, as well as the reduction in hardness, can be set at 18. The numeral 16 designates a servo system for the rider roll 15.

Figure 2:
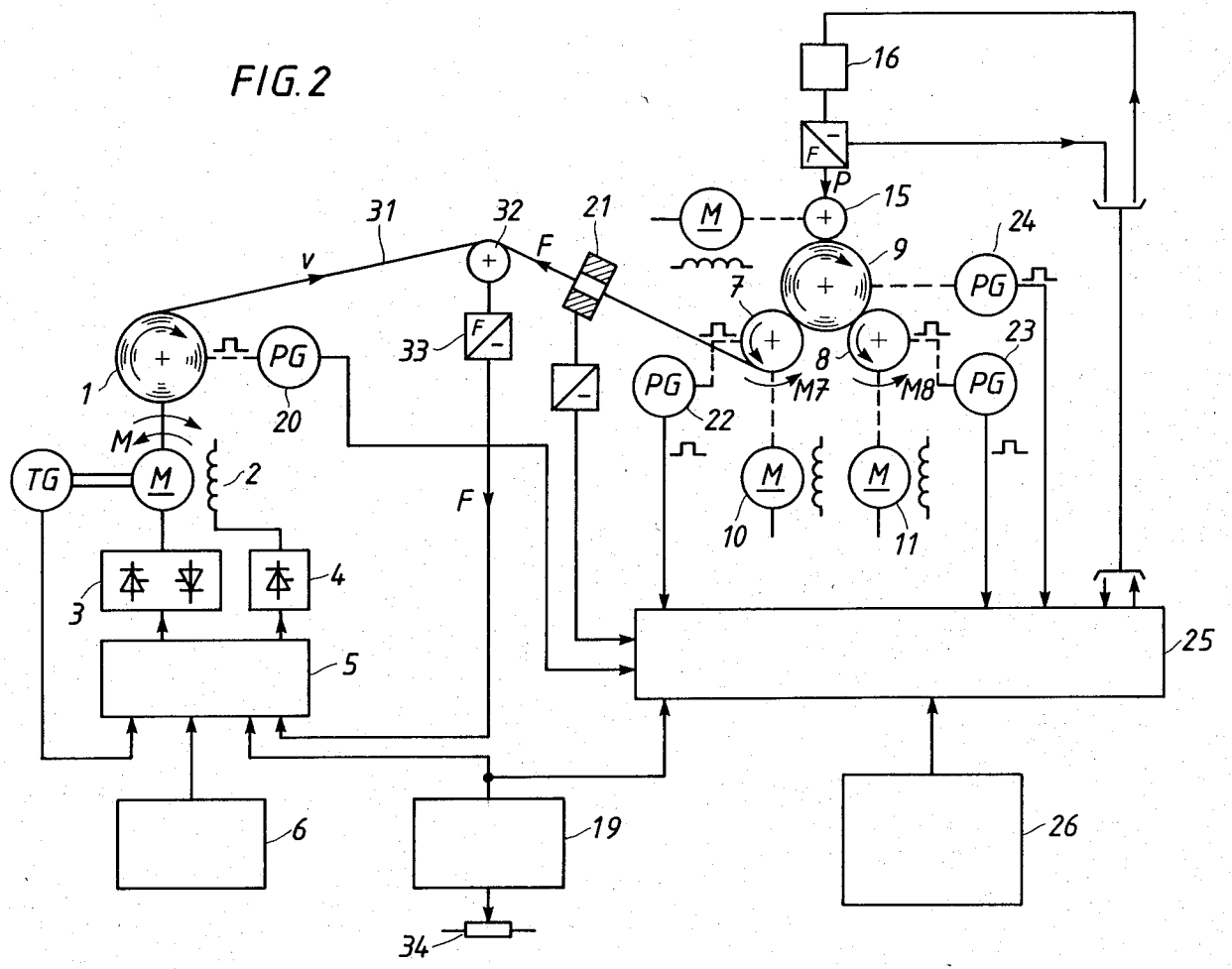
FIG. 2 shows schematically apparatus for regulating the tension of a paper web as it is wound into a paper roll, the apparatus being operable in accordance with a method according to the invention.

The method according to the invention and apparatus for carrying out the method are exemplified in FIG. 2. In this figure, the motor drive system, the control equipment for unrolling, and the central reference system are the same as in FIG. 1.

Pulse generators 22 and 23 are used for computing the speed difference (n7−n8) between supporting roller 7 and supporting roller 8. This difference is used to control the tensions (material or mechanical tensions) wound into the finished roll 9. This results in a well-controlled feedback control. During acceleration and deceleration, the speed control becomes better than previously; among other things, slipping is eliminated.

The speed signals from pulse generators 22 and 23 are supplied to a control member 25. The numeral 26 designates a device for setting the desired hardness (desired value) in the roll. The torque signal is here *not* supplied to the control member 25 (contrary to the case in FIG. 1), and slipping between the roll 9 and the supporting rollers (7,8) can thus be avoided. A certain speed difference applied between the supporting rollers (7,8) automatically results in a certain hardness (material tensions in the roll 9). A certain desired value for the speed difference is set in the device 26, which difference is compared with the difference obtained (e.g. in 24) in a closed control loop (25) and the error signal obtained is used to control the speed difference between the rollers 7 and 8, thereby to control or regulate the internal tension of the paper roll 9 during its winding.

The speed control gives a curve shape of the torque according to FIG. 5, that is, the same as in the conventional case at constant speed.

Controlling the roll hardness (i.e., the internal web tension of the roll) only with the speed difference control in the finished roll may sometimes be inadequate, since variations in the paper tension F and the rider roll pressure P, etc., may involve certain problems, and it is preferable to use further parameters to control the winding operation.

For example, a pulse generator 24 is provided at the finished roll 9 for counting the number of wound turns of the roll 9. With knowledge of the number of wound turns and of the length of paper wound onto the roll 9 (which is obtained by means of the pulse generators 22, 23), and of the surface weight (i.e., weight per unit area) of the paper (which is registered in the paper machine), a value of the density (hardness) of the finished roll 9 can be computed. For example, over a measuring period, the roll undergoes a change in mass, ΔM, and a volumetric change, ΔV, where:

$$\Delta M = \text{surface weight} \times \text{length (L)} \times \text{width} \quad (1)$$

$$\Delta V = k \times (D1^2 - D2^2) \times \text{width}, \quad (2)$$

where k is a constant and D1 and D2 (see FIG. 4) are the roll diameters at the end and at the beginning, respectively, of the measuring period. From formulae (1) and (2), the density δ of the part of the roll formed during the measuring period is calculated as follows:

$$\delta = \frac{\Delta M}{\Delta V} = \frac{\text{surface weight}}{k \times (D1^2 - D2^2)} \times \text{length } (L), \text{ kg/m}^3$$

At least in the case where the web tension in the roll is controlled so as to be substantially constant throughout the roll (as is desirable), the quotient $^1/D1^2 - D2^2$ is a function of the number of turns wound onto the roll in any measuring period and of the web thickness.

A changed density in roll 1 gives a changed thickness (at 21) and results in a changed speed relationship between motor 10 and motor 11. A thickness signal can be obtained at 21 by conventional means and this signal may be supplied to the control member 25 in order to change (if necessary) the speed relationships.

With a superordinate density control, corrected for variations in thickness of the paper web, a considerably improved control is obtained of the built-in stress profile of the finished roll.

The density control can also act directly on the speed control without having to pass via the speed difference control if a sufficiently rapid updating of the density value can be achieved.

The invention can be varied in many ways within the scope of the following claims.

What is claimed is:

1. A method of controlling the web tension of a web roll, in particular a paper web roll, being wound in a winder including two individually driven web roll supporting rollers, comprising:

deriving separate signals representative of the speed of rotation of each supporting roller:

controlling the speed or rotation of each driven supporting roller, in dependence on the difference between the said signals, thereby to control the said web tension of the web roll;

including measuring the number of wound turns and the wound web length of the web of a measuring period, the resulting measurement signals being supplied with information about the surface weight of the web to a device for computing a density signal for the portion of the web roll formed during the measuring period, the density signal being used as a superordinate control signal for controlling the web tension of the web roll.

2. A method according to claim 1, including measuring the speed of rotation of each supporting roller to obtain the said signal.

3. A method according to claim 1, including measuring the speeds of rotation of drive members for the supporting rollers to obtain the said signals.

4. A method according to claim 1, wherein the density signal is supplied to speed control devices of motors of the supporting rollers.

5. A method according to claim 1, wherein the density signal is supplied to a control member for controlling the difference between the speeds of rotation of the two supporting rollers.

* * * * *